US011352706B2

(12) United States Patent
Yañez Castañeda

(10) Patent No.: US 11,352,706 B2
(45) Date of Patent: Jun. 7, 2022

(54) DEVICE AND SYSTEM FOR ELIMINATING ELECTRODE EDGE STRIPS

(71) Applicant: Percy Danilo Yañez Castañeda, Antofagasta (CL)

(72) Inventor: Percy Danilo Yañez Castañeda, Antofagasta (CL)

( * ) Notice: Subject to any disclaimer, the term of this patent is extended or adjusted under 35 U.S.C. 154(b) by 229 days.

(21) Appl. No.: 16/570,947

(22) Filed: Sep. 13, 2019

(65) Prior Publication Data

US 2020/0181786 A1 Jun. 11, 2020

Related U.S. Application Data

(60) Provisional application No. 62/730,639, filed on Sep. 13, 2018.

(51) Int. Cl.

| | |
|---|---|
| ***C25C 7/06*** | (2006.01) |
| ***C25C 7/00*** | (2006.01) |
| ***C25C 7/08*** | (2006.01) |

(52) U.S. Cl.
CPC ..... *C25C 7/06* (2013.01); *C25C 7/00* (2013.01); *C25C 7/08* (2013.01)

(58) Field of Classification Search
CPC ..... C25C 7/00; C25C 7/06; C25C 7/08
See application file for complete search history.

(56) References Cited

U.S. PATENT DOCUMENTS

| | | | | |
|---|---|---|---|---|
| 5,002,642 | A * | 3/1991 | Kaneko | C25C 7/00 205/560 |
| 5,549,801 | A * | 8/1996 | Perlich | C25C 7/02 204/279 |
| 5,762,776 | A * | 6/1998 | Alexander | C25D 17/12 204/267 |
| 2009/0173624 | A1* | 7/2009 | Aylwin G. | C25C 7/00 204/297.01 |
| 2019/0078223 | A1* | 3/2019 | Yanez Castaneda | C25C 7/04 |

* cited by examiner

*Primary Examiner* — Nicholas A Smith
(74) *Attorney, Agent, or Firm* — Foley & Lardner LLP

(57) ABSTRACT

An electrolyte flow regulator device and system that eliminates electrode edge strips, preferably cathodes edge strips, by obstructing the passage of the rich electrolyte to be electrodeposited and by the electrical isolation caused by the side walls of the device in the area where the edge strip was originally arranged, being able to obtain edges of an electrode without electrodeposition.

12 Claims, 12 Drawing Sheets

DEVICE AND SYSTEM FOR ELIMINATING ELECTRODE EDGE STRIPS

CROSS-REFERENCE TO RELATED PATENT APPLICATION

This application claims priority from U.S. Provisional Application Ser. No. 62/730,639, filed Sep. 13, 2018, which is incorporated herein by reference in its entirety.

This application refers to an electrolyte flow regulator device, that eliminate electrode edge strips, preferably from cathodes, and to an associated system including at least four of said electrolyte flow regulator devices. The devices are preferably plastic and reduce almost to zero rejections due to jacketing caused by faulty or loose edge strips, increasing the production of metal cathodes obtained from electrolytic processes. Additionally, said device and system is installed along the sides of each anode, being able to reach the bar where the anode rests on the so-called capping boards, in the upper portion, and in the lower portion of the device length, they reach the base level of the permanent cathode.

BACKGROUND OF THE INVENTION

It is well known that in more than 95% of the electrolytic process plants for the production of metallic cathodes, for example by electro-winning and electrolytic refining existing in Chile and in the World, permanent cathodes of different materials are used, preferably of stainless steel, which have edge strips incorporated on the sides, preferably of plastic, in order to separate the electrodeposited plates on both sides of the permanent cathode.

The detachment operation of electrodeposited plates takes place at the harvesting time after a sowing cycle that can vary between 4 and 7 days. The harvesting operation itself and mainly the action of detaching the electrodeposited metallic cathode can be performed by hand or through a detaching machine. In both cases, the detachment is performed by applying repeated blows with metallic rubber-coated trunnions over the metallic electrodeposited plates that are adhered to the permanent cathodes. After being struck, the cathode plates are bent from one side to the other, being able to slightly separate the electrodeposited plates of permanent cathodes. Finally, after said slight separation of the electrodeposited plates has been reached, metallic wedges are introduced between the electrodeposited plates and the permanent cathodes, thus detaching the metallic electrodeposited plates on both sides.

The detachment operation method works in a relative good way within the first 6 months after the installation of new edge strips; after this time, the detachment operation produces fatigue over both the permanent cathode, which surface becomes marked, scratched or slightly bent, and the edge strip, which usually comes loose from the permanent cathode, provoking its partial or full detachment, resulting in the undesired jacketing, i.e. the partial or total joining of the electrodeposited plates by one or both sides. Said jacketing makes the detachment of the electrodeposited plates almost impossible; this makes it necessary to remove the jacketed permanent cathode from the production line, so that it may be mechanically separated at external workshops, which raises production costs. Rejections for this concept may range between 2% and 15% depending on the condition of the permanent cathodes and of the edge strips.

In this context, at present there is a solution to the problem mentioned above, which corresponds to huge systems of the size of the electrolytic cell, where said systems separate the anodes from the cathodes in an equidistant way, using guides in the form of channels for anodes and cathodes to displace vertically over them during the processes of introduction and removal of electrode plates. Said solution can be seen in the documents US2007284243, WO2016054753, WO2016054754 and WO2016054755.

Said guiding devices which are applied when permanent cathodes do not use edge strips, work well when anodes and cathodes are perfectly vertical, i.e., while they are new or with little use. However, when anodes begin to be used, they start to corrode anyway, losing thickness and becoming deformed as already stated, and the same happens to permanent cathodes. Then, when the extraction of deformed anodes and/or cathodes is required, the displacement guides turn into an obstacle making the operation inefficient, since the deformation of electrodes due to their use make the displacement of them through said guides difficult. Drawbacks of this system are, therefore, its high cost of implementation, added to the guiding channels not being able to straighten or stiffen the anodes after their deformation, thus making the harvest process and/or the removal of plates difficult for the sliding of cathodic and anodic plates becoming locked.

In this context a solution is required that not only prevents cathodes becoming jacketed, but also providing stiffness to anodes and cathodes, allowing both cathodes and anodes to be extracted/introduced from/to the cells in an easy uninterrupted way.

Additionally, in order to prevent the aforementioned jacketing, other current solutions use complex systems to isolate the edges of the cathode. The solution in U.S. Pat. No. 7,217,345 falls within this type of solutions by implementing energized isolating devices installed as edge strips, controlling the deposition of metal on the edges by the application of an electromagnetic field that prevents the deposition of metal towards the edge of the cathodic plate.

Although the previous solution allows solving the jacketing problem, it is energetically inefficient, implementing an energized active system that is not only expensive, but which must be operated and maintained on a regular basis. In addition, said solution does not prevent the deformation of the cathodic and anodic plates, since it does not provide stiffness to the plates.

In this context, a solution is required that not only prevents cathodes becoming jacketed, but being also energetically efficient and cost saving, providing stiffness to anodes and cathodes, without requiring complex devices that use electromagnetic fields in order to prevent the deposition of metal towards the edges of the cathodic plate.

Finally, it is important to note that the document US2016160375 proposes electrode-stiffening devices to replace the use of guides and separators and to reduce the deformation of anodes, while increasing the useful life of anodic plates and improving the efficiency of the electrodeposition. Although said device solves the rigidity issue of plates, it does not propose a solution to the jacketing problem of cathodes or to the elimination of edge strips.

Therefore, the main problem solved by this invention is to eliminate the edge strips of permanent cathodes by implementing simple and energy-efficient devices, thus avoiding the problems associated with the use of edge strips, as costs associated with their use, the fatigue thereof during the operation that causes their partial or total detachment, and the resulting rejection of production of metallic cathodes due to jacketing, which reduces the maintenance costs of "mother" cathodes significantly, since it is no longer necessary taking them of the worksite in trucks for their detachment at external workshops. By eliminating these rejections, the harvest speed of the metallic cathodes increases.

It is also sought for the solution to keep rigidity of anodes and the distance between anode and cathode throughout their length in an equidistant way, thus reducing rejections due to the formation of nodules (nodulation) almost to zero, which translates into an increase in the production of excellent quality metallic cathodes.

BRIEF DESCRIPTION OF THE INVENTION

The invention refers to an electrolyte flow regulator device that eliminates the edge strips of electrodes, preferably cathodes, by throttling the pass of the rich electrolyte to be electrodeposited and the electric insulation caused by the side walls of the device in the area where the edge strip originally housed, being able to leave the edges of an electrode without electrodeposition. Then, when the edge strips are not used, the harvest is performed faster and rejections of attached cathodes are substantially reduced, as a result of lateral jacketing and/or poor operation of edge strips, whether they are in bad condition, defective or have loosen due to fatigue. All of this translates into an increased production of high quality metallic cathodes.

The invention is also able to straighten the twisted anodes keeping the equidistance between adjacent anodes and thus preventing short-circuits between anodes and cathodes during electrodeposition processes. Additionally, the electrolyte flow regulator device produces the homogeneous distribution of current in all cathodes, thus getting to maximize the current efficiency of cells.

According to a preferred embodiment of the invention, the electrolyte flow regulator device comprises a rigid monolithic body with side walls incorporating an electrolyte flow regulating element on the sides of the device. The electrolyte flow regulating element seeks to control the deposition over a target electrode adjacent to the electrode having the device. In fact, two adjacent devices allow throttling the electrolyte flow in area of the edge of the target electrode found between said adjacent devices, thus preventing the electrodeposition over said edge and avoiding the need of using edge strips.

According to a first embodiment of the invention, said flow regulating element corresponds to slightly inclined lateral walls configuring a U or V-shaped cross-section which is wider in its rear portion. Said inclined side walls reach the front part of the device. The front part of the electrolyte flow regulator device has one or two inclinations on each side, which angle determines the greater or lesser extent of electrodeposition in the target area of the cathode. Additionally, the middle portion of the device has a fitting area for the electrode arranged in such a way to tightly house the peripheral edge of the whole electrode, preferably of an anode, throughout the side continuously. Said electrode fitting area of the device extends in order to include the bar to hold the electrode in the cell through an upper fitting area, straightening the electrode along its extension and separating it from the adjacent electrodes.

According to a second embodiment of the invention presented as a variation of the first embodiment described above, the electrode fitting area having the electrolyte flow regulator device is presented to tightly house the peripheral edge of the electrode in part of its lateral extension, having some discrete fitting areas. According to the preferred alternative, the electrode fitting area has three discrete fitting areas, one to each upper and lower end of the lateral edge and another one to the middle portion of the electrode. Additionally, according to said second embodiment, the device has a hollow structure with a number of through openings along its extension. Said through openings allow the free pass of the metal-rich electrolyte to be electrodeposited in the deposition area. Through said through openings the uniform deposition of the metal in the cathode is achieved, allowing the renewal of the electrolyte by facilitating its free circulation through said through openings.

According to a third embodiment of the invention, the electrolyte flow regulator device comprises a rigid monolithic body of lateral walls which are parallel each other, thus making up a rectangular U-shaped cross-section, with the side walls having a step-shaped recess as electrolyte flow regulating element, where the lesser length of the step along the side walls shall determine the non-electrodeposition in the cathode's target area. Said stepped recess has a first level that allows housing the cathode and leaving the area free of deposition, while a second level of the step shall allow leaving the electrolyte without passing along the electrode. In the middle front portion of the device there is a fitting area arranged to tightly house the peripheral edge of the whole electrode, preferably an anode, throughout its side extension or in part of its lateral extension. Said fitting area of the device also includes the bar to hold and support the electrode in the cell through an upper fitting area, straightening it along its extension and separating it from the adjacent electrodes.

According to a fourth embodiment of the invention, the electrolyte flow regulator device comprises a rigid monolithic body with lateral parallel sides each other, thus making up a H-shaped cross-section, with the side walls having a step-shaped recess as a electrolyte flow regulating element, where the lesser length of the step along the side walls shall determine the non-electrodeposition in the cathode's target area. Said stepped recess has a first level that allows housing the cathode and leaving the area free of deposition, while a second level of the step shall allow leaving the electrolyte without passing along the electrode. In the middle front portion of the device there is a fitting area arranged to tightly house the peripheral edge of the whole electrode, preferably an anode, throughout its side extension or in part of its lateral extension. Said fitting area of the device also includes the bar to hold and support the electrode in the cell through an upper fitting area, straightening it along its extension and separating it from the adjacent electrodes.

Additionally, the invention comprises an electrolyte flow regulator system in order to eliminate the edge strips from an electrode, said system being formed by the combination of at least four electrolyte flow regulator devices of the invention according to any of the embodiments above, i.e. a pair by each anode, arranged on the side edges thereof and acting combined over a cathode, thus avoiding the formation of jacketing on the cathode's side edges by throttling the flow of electrolyte in the cathode's edge area, preventing the electrodeposition over said edge and preventing the need of using edge strips.

BRIEF DESCRIPTION OF THE FIGURES

As part of the present invention, the following representative figures thereof are presented, which show preferred embodiments of the invention and, therefore, they must not be considered as limiting the definition of the subject matter claimed.

DETAILED DESCRIPTION OF A PREFERRED EMBODIMENT

Figure 1:
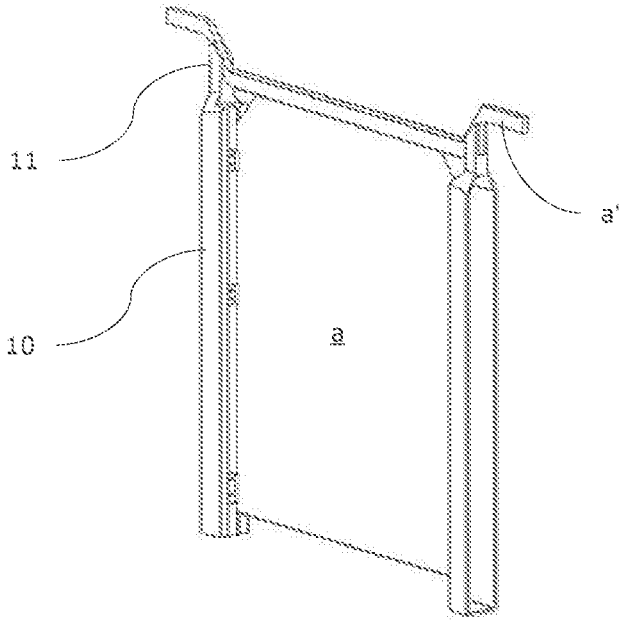
FIG. 1 shows the scheme of an electrode, preferably an anode, having two electrolyte flow regulator devices according to a first embodiment of the invention.

FIG. 1 shows the scheme of an electrode (a), preferably an anode, having two electrolyte flow regulator devices (10) according to a first embodiment of the invention, arranged on each side edge of the electrode (a). It can be noted in said figure that the device (10) covers the whole extension of the electrode (a), including an upper fitting area (11) with the holding bar (a') of the electrode (a) towards the upper portion of the device (10).

The upper fitting area (11) with the holding bar (a') not only allows the right location and securing the device (10) to the electrode (a), but it also ensures its stiffness along the whole extension. Additionally, the configuration of the upper fitting area (11) facilitates the installation and uninstallation of the device (10).

On the one hand, it can be derived from FIG. 1 that according to an alternative, the device (10) extends over the extension of the electrode (a), at least in its lower portion, thus ensuring the stiffening of electrode (a) along its whole extension. Additionally, this alternative may offer a supporting surface to the device (10) in the electrolytic cell (not shown). Without prejudice to this, other embodiments comprise extensions just covering the extension of the electrode (a), i.e. the device extending from the holding bar (a') to the lower edge of the electrode (a).

Figure 1A:
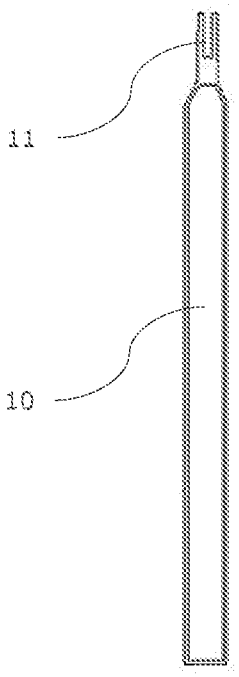
FIGS. 1*a*, 1*b* and 1*c* show the rear, front and side views of the device, respectively, according to the embodiment of FIG. 1.
Figure 1B:
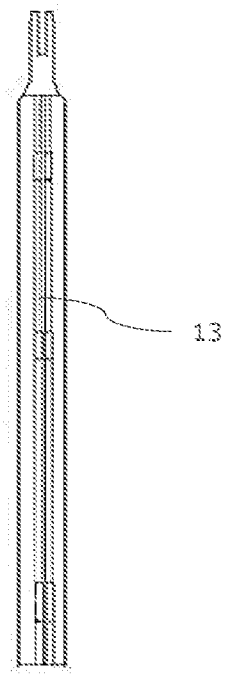
Figure 1C:
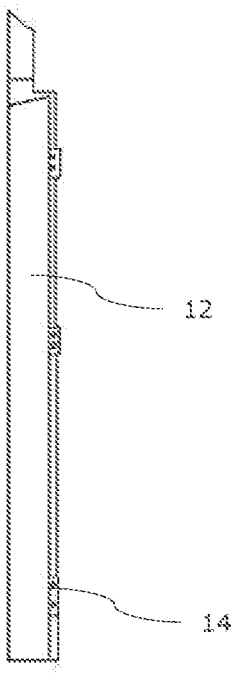

FIGS. 1*a*, 1*b* and 1*c* show rear, front and side views of the device (10), where the upper fitting area (11) can be noted in further detail, as well as the lateral faces (12), the electrode fitting area (13) and the electrode fastening points (14) the device (10) has. In this embodiment, the electrode fitting area (13) is shown in its whole front extension of the device (10) as a single continuous electrode fitting area with electrode fastening points (14) therein.

Figure 1D:
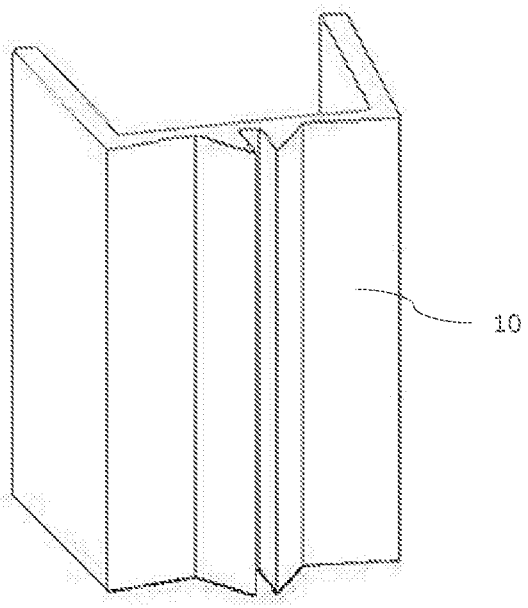
FIGS. 1*d* and 1*e* show perspective and upper views of the device, respectively, according to the embodiment of FIG. 1.
Figure 1E:
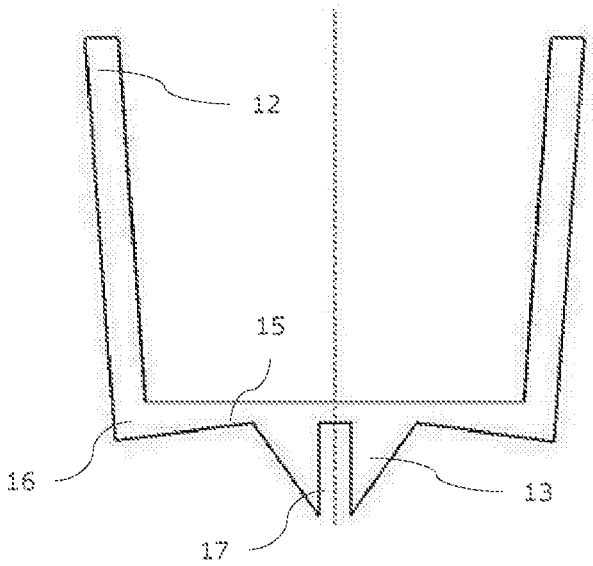

FIGS. 1*d* and 1*e* show a detailed scheme of an embodiment of the device (10) comprising an internal profile which lateral faces (12) and front face (15) provide a U shape with straight lateral and bottom edges and more open to its rear portion, so that to configure the electrolyte flow regulating element. Said profile is symmetrical with respect to a longitudinal plane shown in FIG. 1*e*. The external profile of the device follows the internal profile at least in its lateral faces (12) of the device (10), showing a front face (15) to the electrode fitting area (13) sticking inwards, and presenting a first inclination (16) on each side that defines a lateral external edge protruding from the device's front plane (10) on each side. Said first inclination (16) that configures the lateral front edges of the device protruding from the front plane thereof, allows throttling the flow of electrolyte and blocking the lines of current towards the edge of the cathode as better shown in FIG. 1*g*. Finally, to the middle or central part of the device (10) the electrode fitting area (13) is arranged, configured from a second inclination of the front face that defines a central opening (17) to house the electrode (not shown).

Figure 1F:
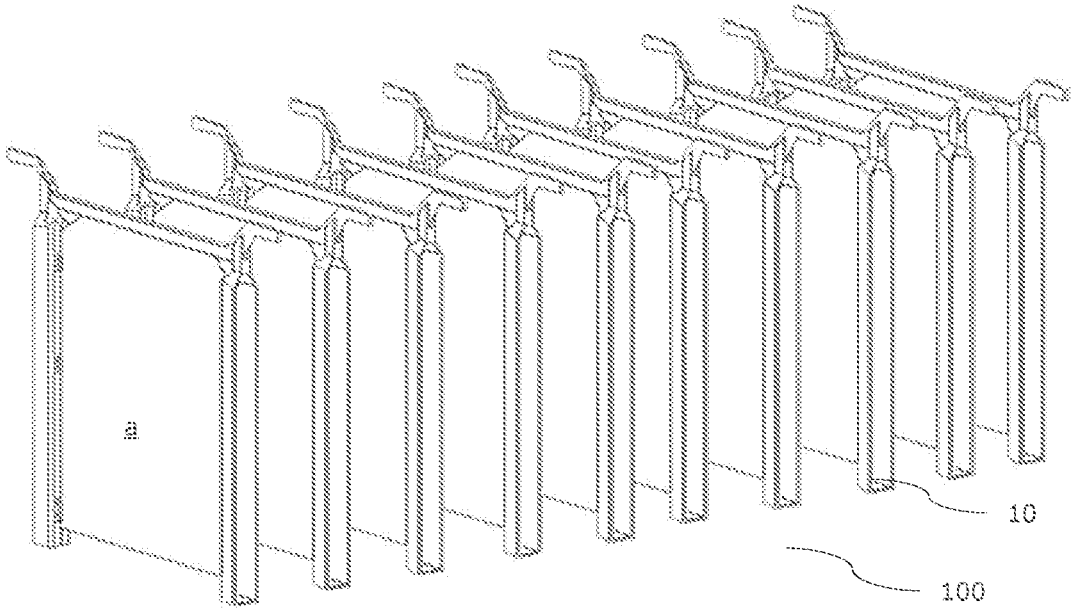
FIG. 1*f* shows a scheme of the device assembled on both side edges of a number of electrodes, preferably anodes, forming the system to eliminate edge strips according to the embodiment of FIG. 1.

FIG. 1*f* shows a scheme of the electrolyte flow regulator device (10) assembled on both side edges of a number of electrodes (a), preferably anodes, forming an electrolyte flow regulator system (100).

Figure 1G:
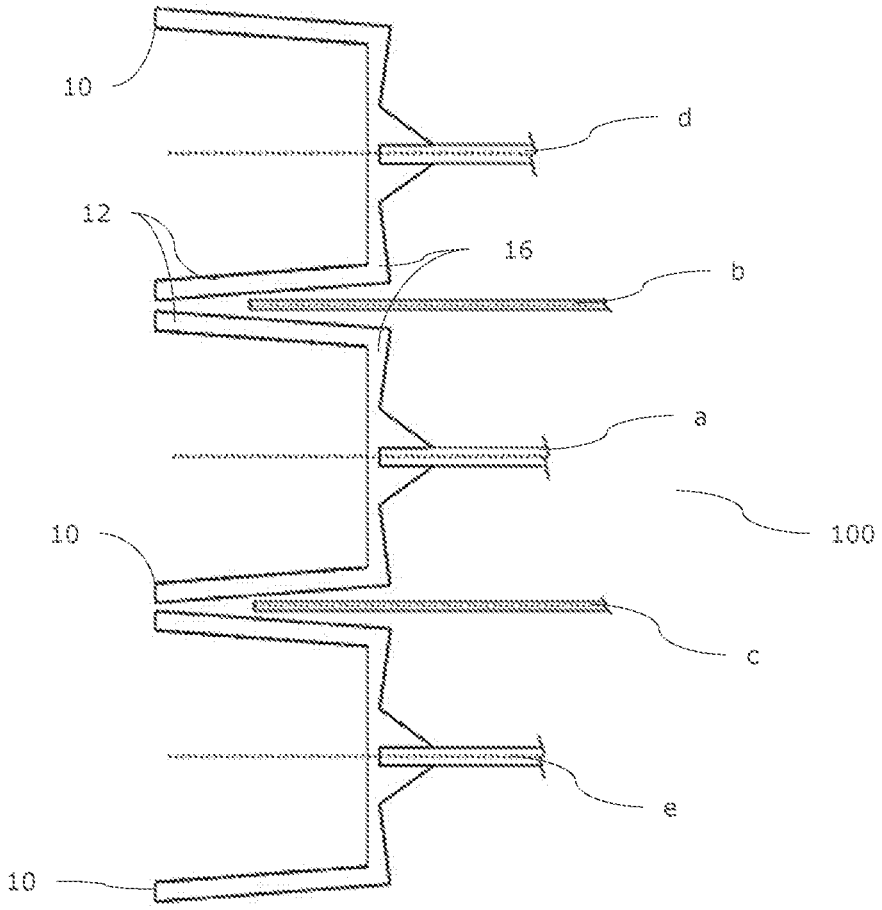
FIG. 1*g* shows the arrangement of the devices that are part of the system of the invention in relation to the adjacent electrodes, according to the embodiment of FIG. 1.

Additionally, FIG. 1*g* shows the arrangement of the devices (10) that are part of the system (100) of the invention in relation to the adjacent electrodes and allowing to identifying the operation of the system (100). In fact, if we consider the central electrode (a) of FIG. 1*g* that comprises the device of the invention (10), two adjacent electrodes, one on each side, shown as free plates (b, c) without any element on the edge (without edge strips) and the adjacent electrodes towards said free plates (d, e) to the ends of FIG. 1*g*, each one of them comprising the device (10) of the invention, it is possible to note that the arrangement of the system of devices of the invention allows preventing the formation of deposit over the edges of the free plates (b, c) thus preventing the jacketing of the plate without the need of having edge strips. In particular, the configuration of the device (10) of the invention, one on each side of a target plate (shown as free plates (b, c)), presenting lateral walls (12) and first inclinations (16), allows throttling the flow of the electrolyte towards the edges of the target plate, thus preventing the electrodeposition over the edges of said plates (b, c).

As an example, the central electrode (a) in FIG. 1*g* is an anode with the device (10) of the invention and, therefore, the two electrodes (b, c) adjacent to said central anode (a) represent cathodes without edge strips, while the electrodes (d, e) to the ends of the figure are also anodes with the device (10) of the invention.

Figure 2:
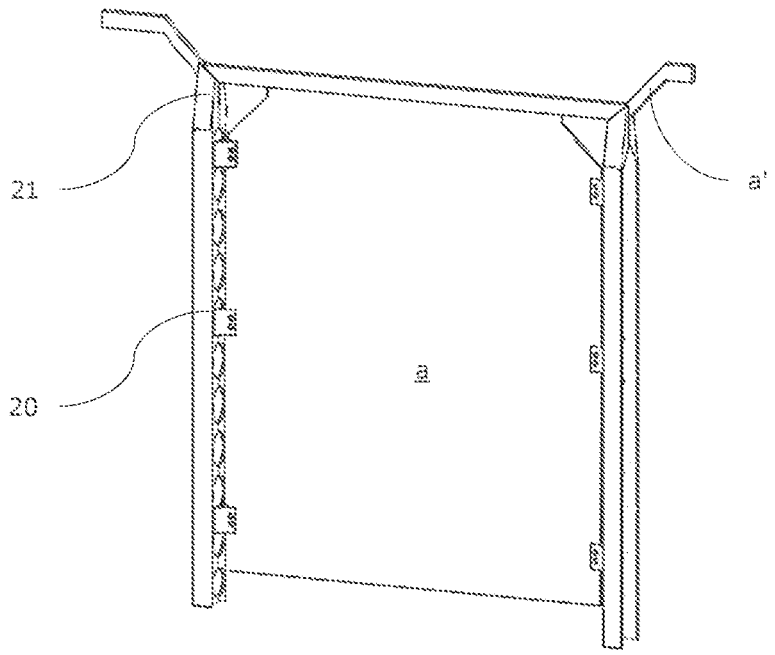
FIG. 2 shows the scheme of an electrode, preferably an anode, having two electrolyte flow regulator devices according to a second embodiment of the invention.

FIG. 2 shows the scheme of an electrode (a), preferably an anode, having two electrolyte flow regulator devices (20) according to the second embodiment of the invention, arranged on each side edge of the electrode (a). It can be noted in said figure that the device (20) covers the whole extension of the electrode (a), including an upper fitting area (21) with the holding bar (a') of the electrode (a) towards the upper portion of the device (20).

The upper fitting area (21) with the holding bar (a') not only allows the right location and securing the device (20) to the electrode (a), but it also ensures its stiffness along the whole extension. Additionally, the configuration of the upper fitting area (21) facilitates the installation and uninstallation of the device (20).

On the one hand, it can be derived from FIG. 2 that according to an alternative, the device (20) extends over the extension of the electrode (a), at least in its lower portion, thus ensuring the stiffening of electrode (a) along its whole extension. Additionally, this alternative may offer a supporting surface to the device (20) in the electrolytic cell (not shown). Without prejudice to this, other embodiments comprise extensions just covering the extension of the electrode (a), i.e. the device extending from the holding bar (a') to the lower edge of the electrode (a).

Figure 2A:
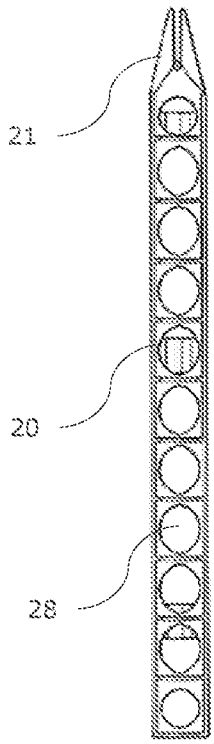
FIGS. 2*a*, 2*b* and 2*c* show the rear, front and side views of the device, respectively, according to the embodiment of FIG. 2.
Figure 2B:
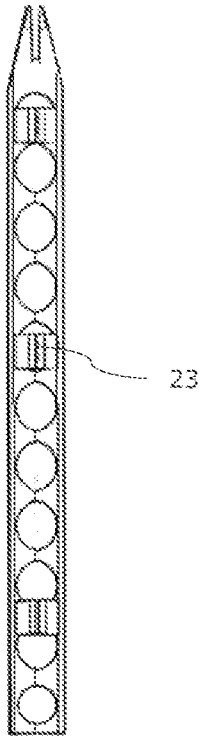
Figure 2C:
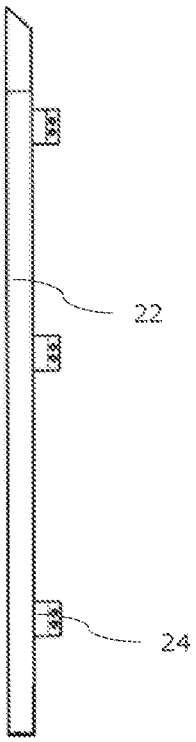

FIGS. 2*a*, 2*b* and 2*c* show rear, front and side views of the device (20), where the upper fitting area (21) can be noted in further detail, as well as the lateral faces (22), the fitting area of the electrode (23) and the fastening points of the electrode (24) the device (20) has. In this embodiment, the electrode fitting area (23) is shown in portions of the front extension of the device (20) as three discrete fitting areas with electrode fastening points (24) therein.

Figure 2D:
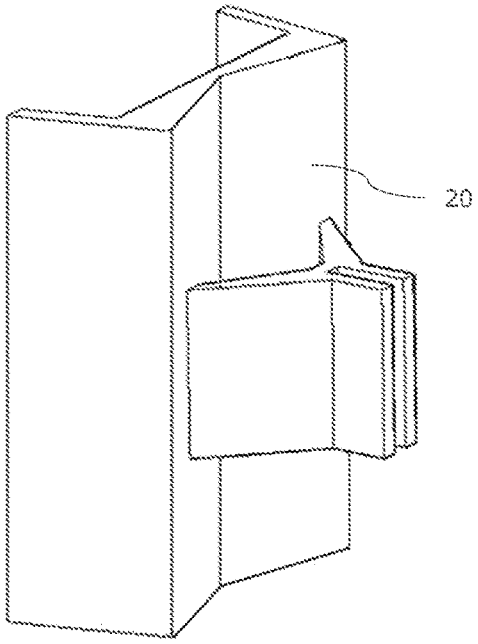
FIGS. 2*d* and 2*e* show perspective and upper views of the device, respectively, according to the embodiment of FIG. 2.
Figure 2E:
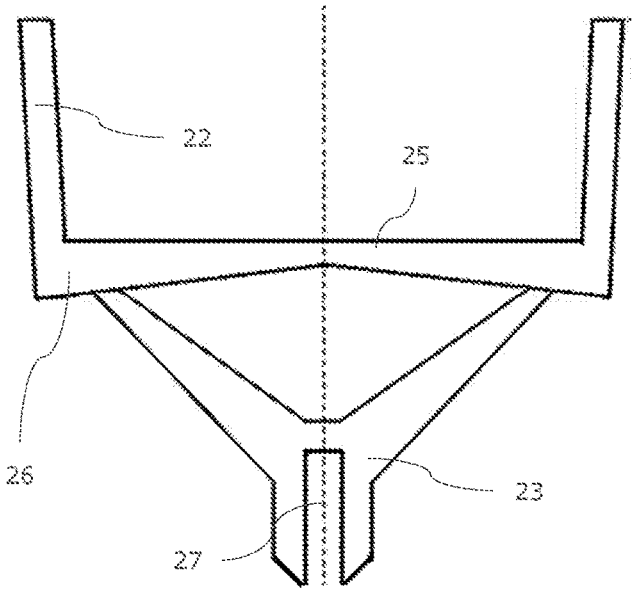

FIGS. 2*d* and 2*e* show a detailed scheme of an embodiment of the device (20) comprising an internal profile which lateral faces (22) and front face (25) provide a U shape with straight lateral and bottom edges and more open to its rear portion, so that to configure the electrolyte flow regulating element. Said profile is symmetrical with respect to a longitudinal plane shown in FIG. 2*e*. The external profile of the device follows the internal profile at least in its lateral faces (22) of the device (20), showing a front face (25) to the electrode fitting area (23) sticking inwards, and presenting a first inclination (26) on each side that defines a lateral external edge protruding from the device's front plane (20) on each side. Said first inclination (26) that configures the lateral front edges of the device protruding from the front plane thereof, allows throttling the flow of electrolyte and blocking the lines of current towards the edge of the cathode as better shown in FIG. 2*g*. Finally, to the middle or central part of the device (20) the electrode fitting area (23) is arranged, configured from a second inclination of the front face that defines a central opening (27) to house the electrode (not shown).

Figure 2F:
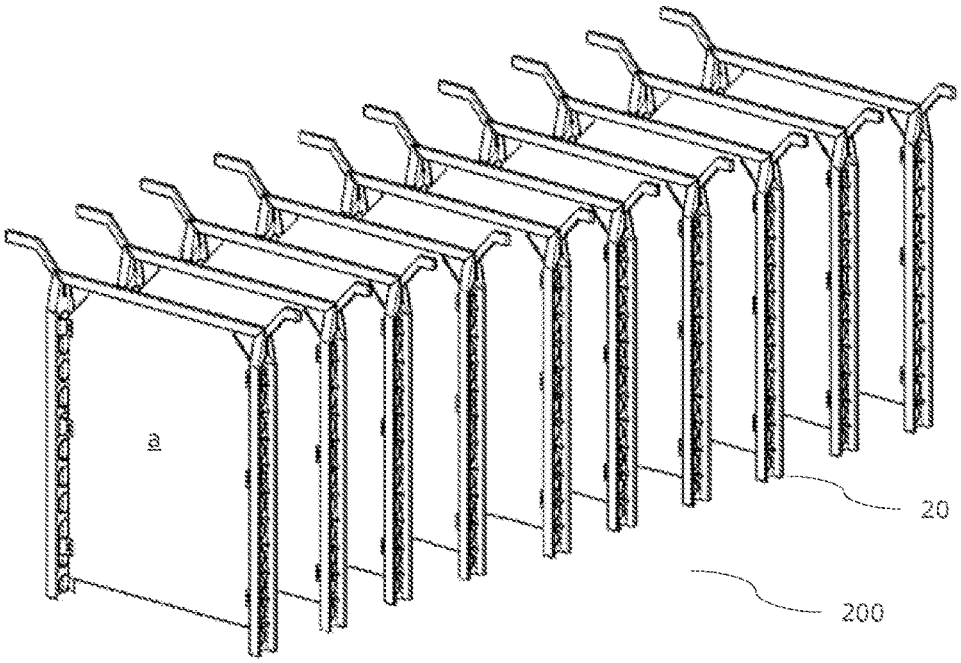
FIG. 2*f* shows a scheme of the device assembled on both side edges of a number of electrodes, preferably anodes, forming the system to eliminate edge strips according to the embodiment of FIG. 2.

FIG. 2*f* shows a scheme of the electrolyte flow regulator device (20) assembled on both side edges of a number of electrodes (a), preferably anodes, forming an electrolyte flow regulator system (200).

Figure 2G:
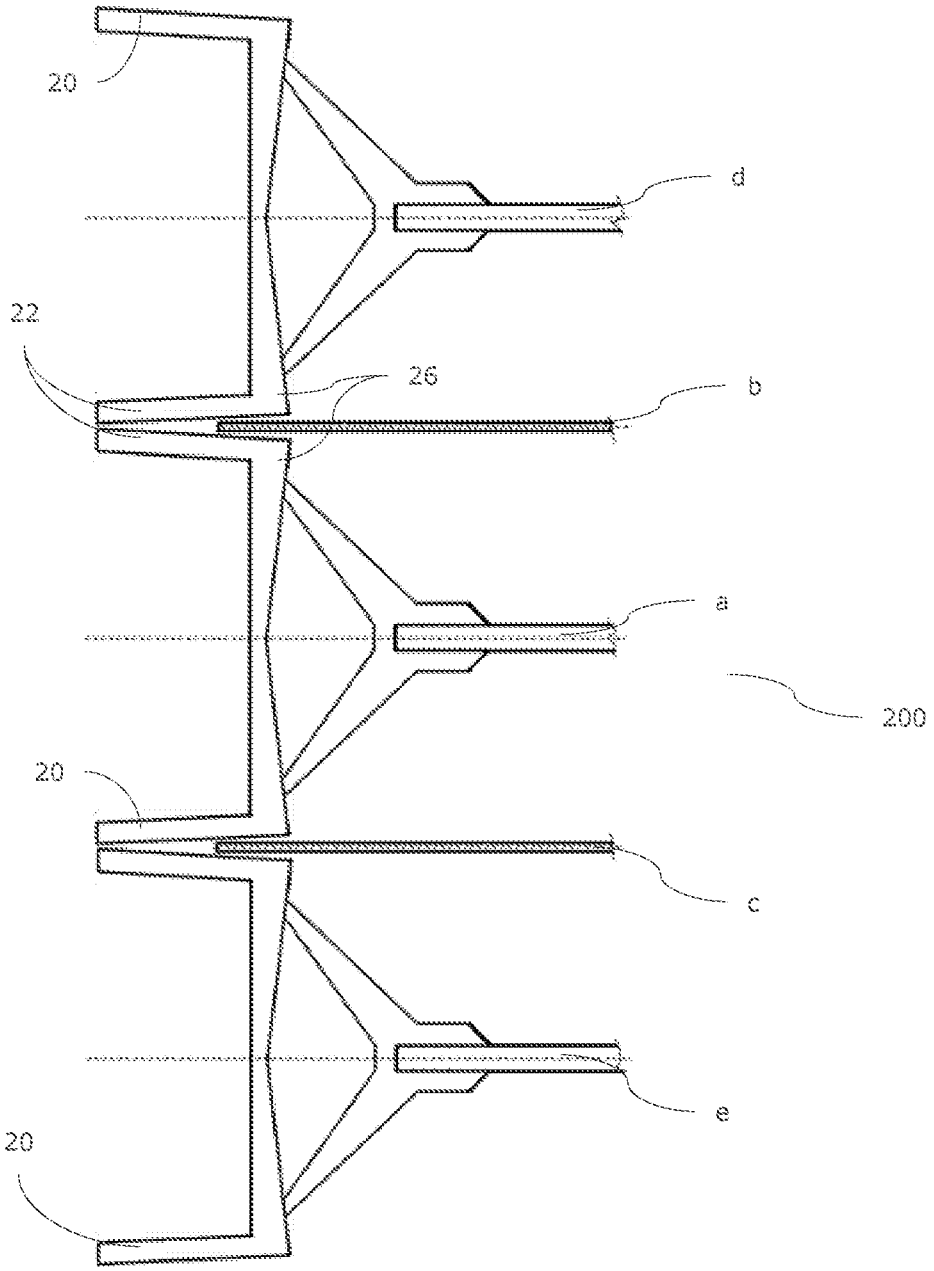
FIG. 2*g* shows the arrangement of the devices that are part of the system of the invention in relation to the adjacent electrodes, according to the embodiment of FIG. 2.

Additionally, FIG. 2*g* shows the arrangement of the devices (20) that are part of the system (200) of the invention in relation to the adjacent electrodes and allowing to identifying the operation of the system (200). In fact, if we consider the central electrode (a) of FIG. 2*g* that comprises the device of the invention (20), two adjacent electrodes, one on each side, shown as free plates (b, c) without any element on the edge (without edge strips) and the adjacent electrodes towards said free plates (d, e) to the ends of FIG. 2*g*, each one of them comprising the device (20) of the invention, it is possible to note that the arrangement of the system of devices of the invention allows preventing the formation of deposit over the edges of the free plates (b, c) thus preventing the jacketing of the plate without the need of having edge strips. In particular, the configuration of the device (20) of the invention, one on each side of a target plate (shown as free plates (b, c)), presenting lateral walls (22) and first inclinations (26), allows throttling the flow of the electrolyte towards the edges of the target plate, thus preventing the electrodeposition over the edges of said plates (b, c).

As an example, the central electrode (a) in FIG. 2*g* is an anode with the device (20) of the invention and, therefore, the two electrodes (b, c) adjacent to said central anode (a) represent cathodes without edge strips, while the electrodes (d, e) to the ends of the figure are also anodes with the device (20) of the invention.

Figure 3:
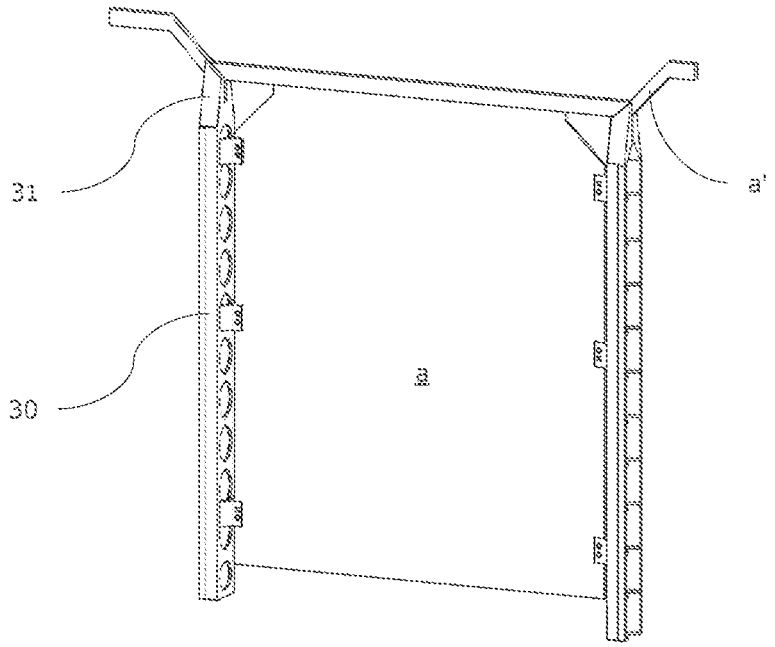
FIG. 3 shows the scheme of an electrode, preferably an anode, having two electrolyte flow regulator devices according to a third embodiment of the invention.

FIG. 3 shows the scheme of an electrode (a), preferably an anode, having two electrolyte flow regulator devices (30) according to the third embodiment of the invention, arranged on each side edge of the electrode (a). It can be noted in said figure that the device (30) covers the whole extension of the electrode, including an upper fitting area (31) with the holding bar (a') of the electrode (a) towards the upper portion of the device (30).

This upper fitting area (31) with the holding bar (a') not only allows the right location and securing the device (30) to the electrode (a), but it also ensures its stiffness along the whole extension. Additionally, the configuration of the upper fitting area (31) facilitates the installation and uninstallation of the device (30).

On the one hand, it can be derived from FIG. 3 that according to an alternative, the device (30) extends over the extension of the electrode (a), at least in its lower portion, thus ensuring the stiffening of electrode (a) along its whole extension. Additionally, this option may offer a supporting surface to the device (30) in the electrolytic cell (not shown). Without prejudice to this, other embodiments comprise extensions just covering the extension of the electrode (a), i.e. the device extending from the holding bar (a') to the lower edge of the electrode (a).

Figure 3A:
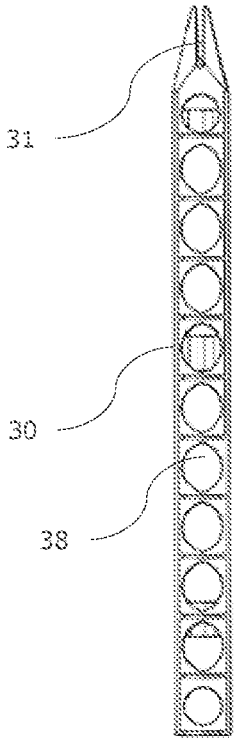
FIGS. 3*a*, 3*b* and 3*c* show the rear, front and side views of the device, respectively, according to the embodiment of FIG. 3.
Figure 3B:
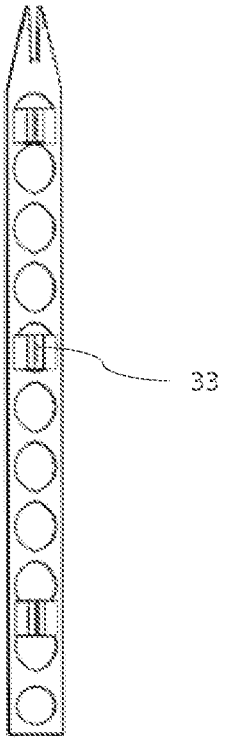
Figure 3C:
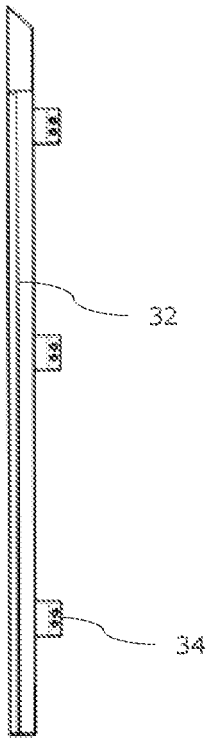

FIGS. 3*a*, 3*b* and 3*c* show rear, front and side views of the device (30), respectively, where the upper fitting area (31) can be noted in further detail, as well as the lateral faces (32), the electrode fitting area (33) and the electrode fastening points (34) the device (30) has.

Figure 3D:
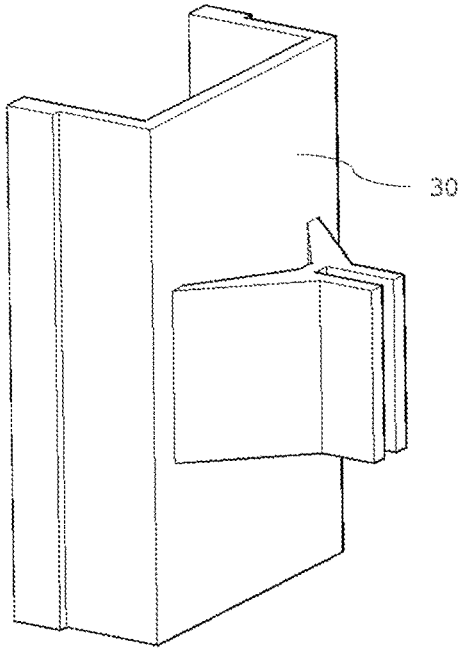
FIGS. 3*d* and 3*e* show perspective and upper views of the device, respectively, according to the embodiment of FIG. 3.
Figure 3E:
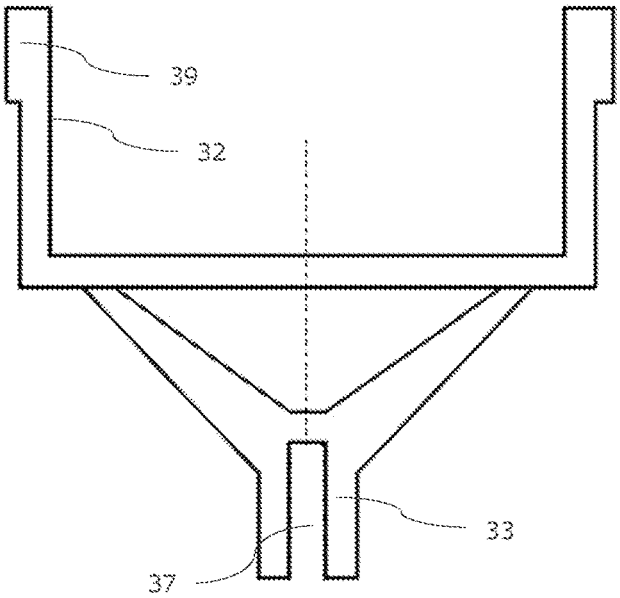

FIGS. 3*d* and 3*e* show a detailed scheme of an embodiment of the device (30) comprising a U-shaped internal profile which parallel lateral faces (32) having a step-shaped recess (39) on each side, which is symmetrical with respect to a longitudinal plane shown in FIG. 3*e* of the device, in order to configure the electrolyte flow regulating element. Said parallel lateral walls (32) have a stepped recess (39) in order to house the cathode and leave the area free of deposition, thanks to a first level of the stepped recess, while a second level of the stepped recess or step (39) shall allow leaving the electrolyte without passing along the electrode and blocking the lines of current to the edge of the cathode, as best shown in FIG. 3*g*. Finally, to the middle or central part of the device (30) the electrode fitting area (33) is arranged, defined by a central opening (37) in order to house the electrode totally or partially as shown in FIG. 3*d*.

Figure 3F:
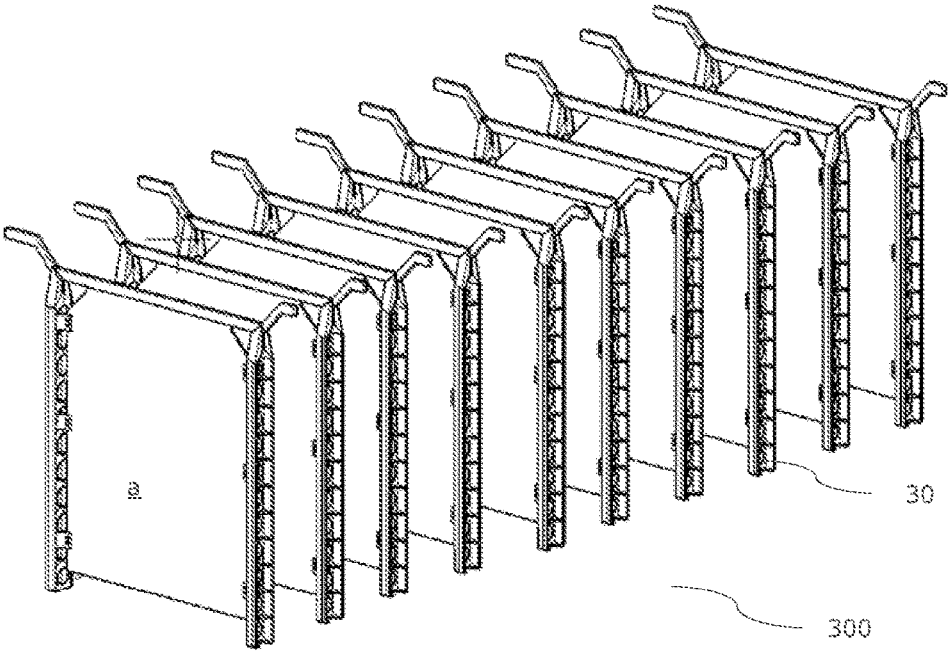
FIG. 3*f* shows a scheme of the device assembled on both side edges of a number of electrodes, preferably anodes, forming the system to eliminate edge strips according to the embodiment of FIG. 3.
Figure 3G:
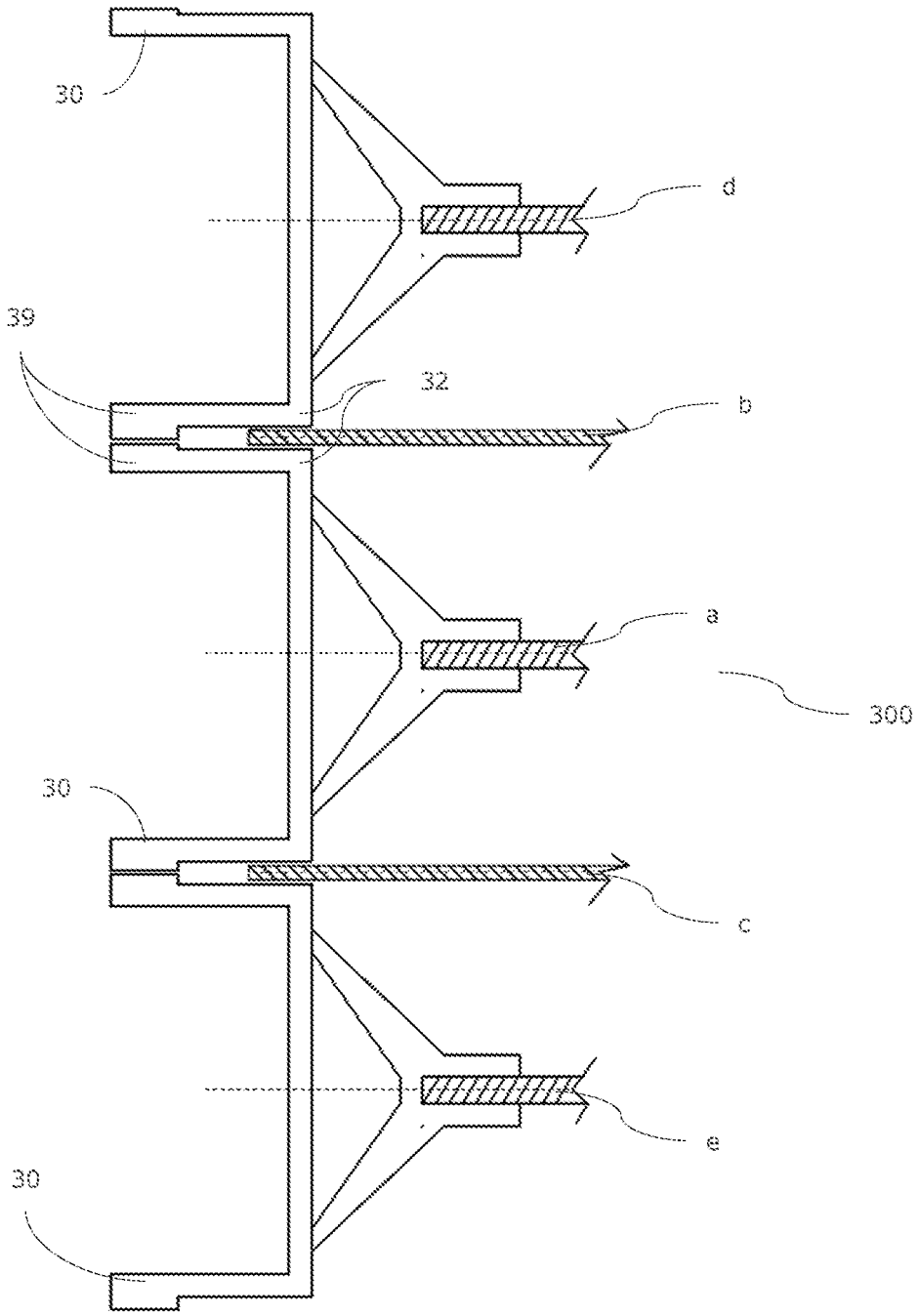
FIG. 3*g* shows the arrangement of the devices that are part of the system of the invention in relation to the adjacent electrodes, according to the embodiment of FIG. 3.

FIG. 3*f* shows a scheme of the electrolyte flow regulator device (30) assembled on both side edges of a number of electrodes (a), preferably anodes, forming an electrolyte flow regulator system (300).

Additionally, FIG. 3*g* shows the arrangement of the devices (30), that are part of the system (300) of the invention in relation to the adjacent electrodes and allowing to identifying the operation of the system. In fact, if we consider the central electrode (a) of FIG. 3*g* that comprises the device (30) of the invention, two adjacent electrodes, one on each side, shown as free plates (b, c) without any element on the edge (without edge strips) and the adjacent electrodes (d, e) towards said free plates (b, c) to the ends of the figure, each one of them comprising the device (30) of the invention, it is possible to note that the arrangement of the system (300) of devices of the invention allows preventing the formation of deposit over the edges of the free plates (b, c), thus preventing the jacketing of the plate without the need of having edge strips. In particular, the configuration of the device (30) of the invention, one on each side of a target plate (b, c), presenting parallel lateral walls (32) and the stepped recess (39), allows throttling the flow of the electrolyte towards the edges of the free plate (b, c), thus preventing the electrodeposition over the edges of said free plate (b, c).

As an example, the central electrode (a) in FIG. 3*g* is an anode with the device (30) of the invention and, therefore, the two electrodes (b, c) adjacent to said central anode (a) represent cathodes without edge strips, while the electrodes (d, e) to the ends of the figure are also anodes with the device (30) of the invention.

Figure 4:
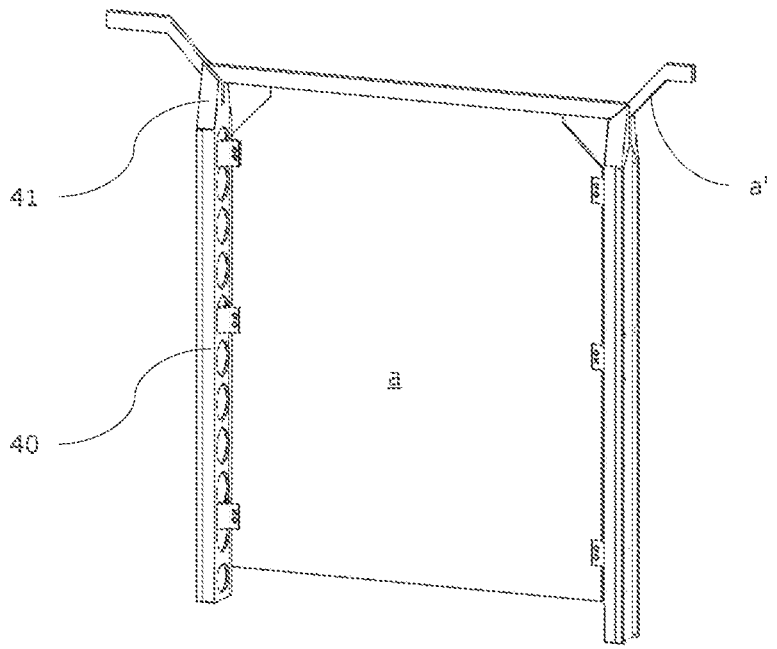
FIG. 4 shows the scheme of an electrode, preferably an anode, having two electrolyte flow regulator devices according to a fourth embodiment of the invention.

FIG. 4 shows the scheme of an electrode (a), preferably an anode, having two electrolyte flow regulator devices (40) according to a fourth embodiment of the invention, arranged on each side edge of the electrode (a). It can be noted in said figure that the device (40) covers the whole extension of the electrode (a), including an upper fitting area (41) with the holding bar (a') of the electrode (a) towards the upper portion of the device (40).

The upper fitting area (41) with the holding bar (a') not only allows the right location and securing the device (40) to the electrode (a), but it also ensures its stiffness along the whole extension. Additionally, the configuration of the upper fitting area (41) facilitates the installation and uninstallation of the device (40).

On the one hand, it can be derived from FIG. 4 that according to an embodiment, the device (40) extends beyond the extension of the electrode (a), at least in its lower portion, thus ensuring the stiffening of electrode along its whole extension. Additionally, this option may offer a supporting surface to the device (40) in the electrolytic cell (not shown). Without prejudice to this, other embodiments comprise extensions just covering the extension of the electrode (a), i.e. the device (40) extending from the holding bar (a') to the lower edge of the electrode (a).

Figure 4A:
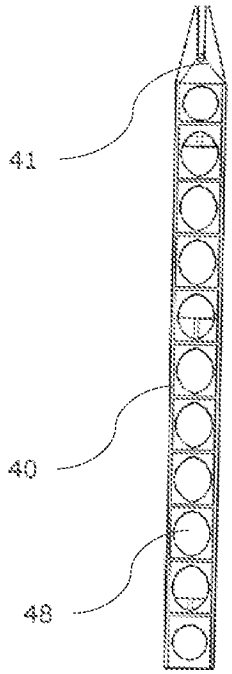
FIGS. 4*a*, 4*b* and 4*c* show the rear, front and side views of the device, respectively, according to the embodiment of FIG. 4.
Figure 4B:
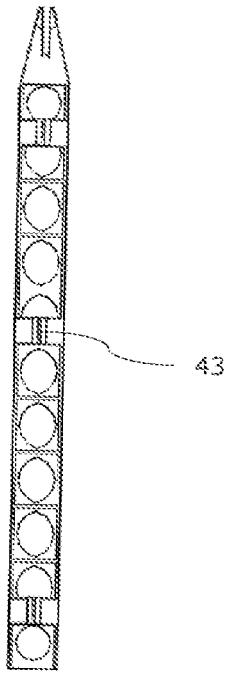
Figure 4C:
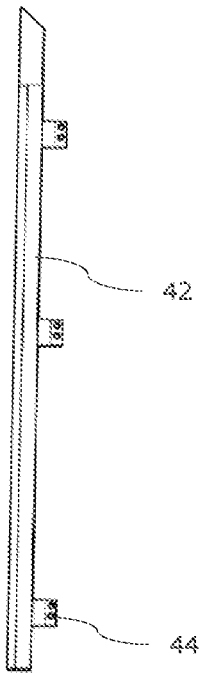

FIGS. 4*a*, 4*b* and 4*c* show rear, front and side views of the device (40), respectively, where the upper fitting area (41) can be noted in further detail, as well as the lateral faces (42), the electrode fitting area (43) and the electrode fastening points (44) the device (40) has.

Figure 4D:
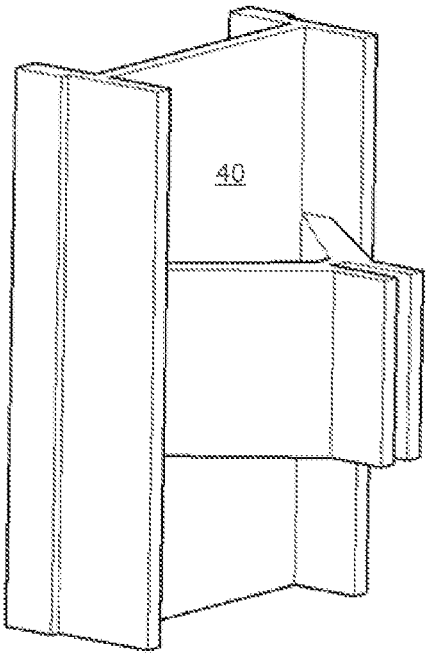
FIGS. 4*d* and 4*e* show perspective and upper views of the device, respectively, according to the embodiment of FIG. 4.
Figure 4E:
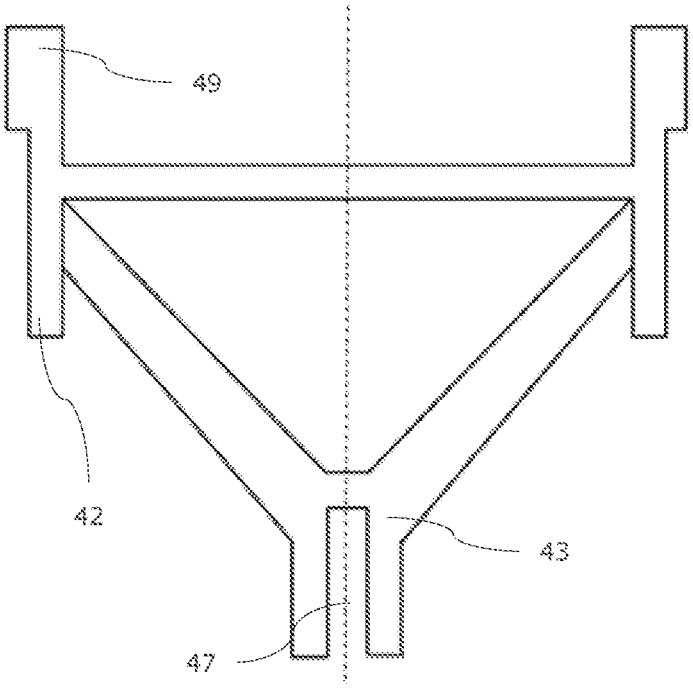

FIGS. 4*d* and 4*e* show a detailed scheme of an embodiment of the device (40) comprising an H-shaped internal profile which lateral faces (42) having a step-shaped recess (49) on each side, which is symmetrical with respect to a longitudinal plane shown in FIG. 4*e* of the device (40), in order to configure the electrolyte flow regulating element. Said parallel lateral walls (42) have a stepped recess (49) in order to house the cathode and leave the area free of deposition, thanks to a first level of the stepped recess, while a second level of the step (49) shall allow leaving the electrolyte without passing along the electrode and blocking the lines of current to the edge of the cathode, as best shown in FIG. 4*g*. Finally, to the middle or central part of the device (40) the fitting area (43) is arranged, defined by a central opening (47) in order to house the electrode totally or partially as shown in FIG. 4*d*.

Figure 4F:
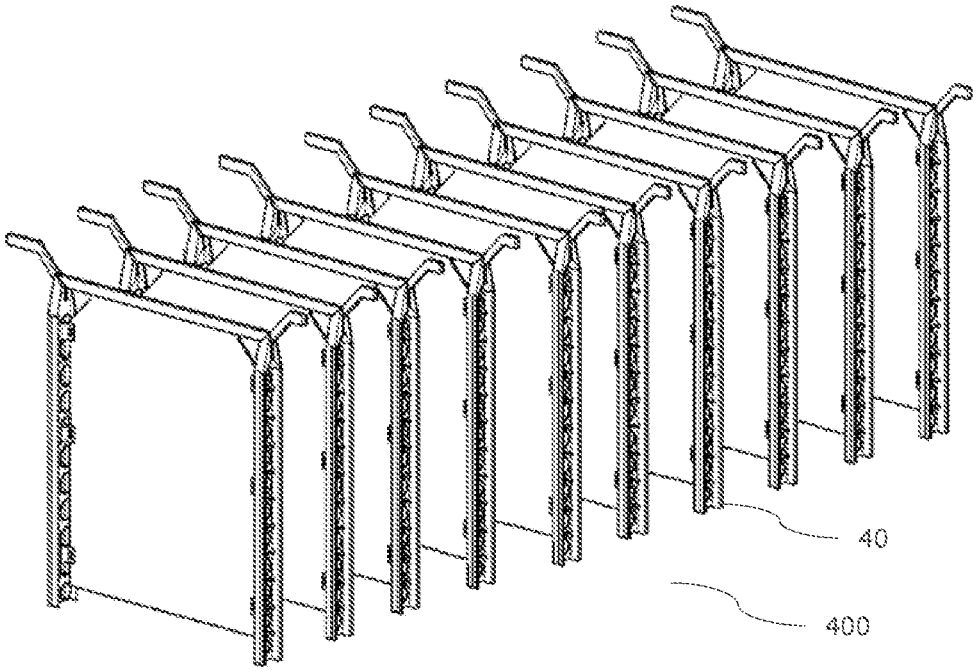
FIG. 4*f* shows a scheme of the device assembled on both side edges of a number of electrodes, preferably anodes, forming the system to eliminate edge strips according to the embodiment of FIG. 4.
Figure 4G:
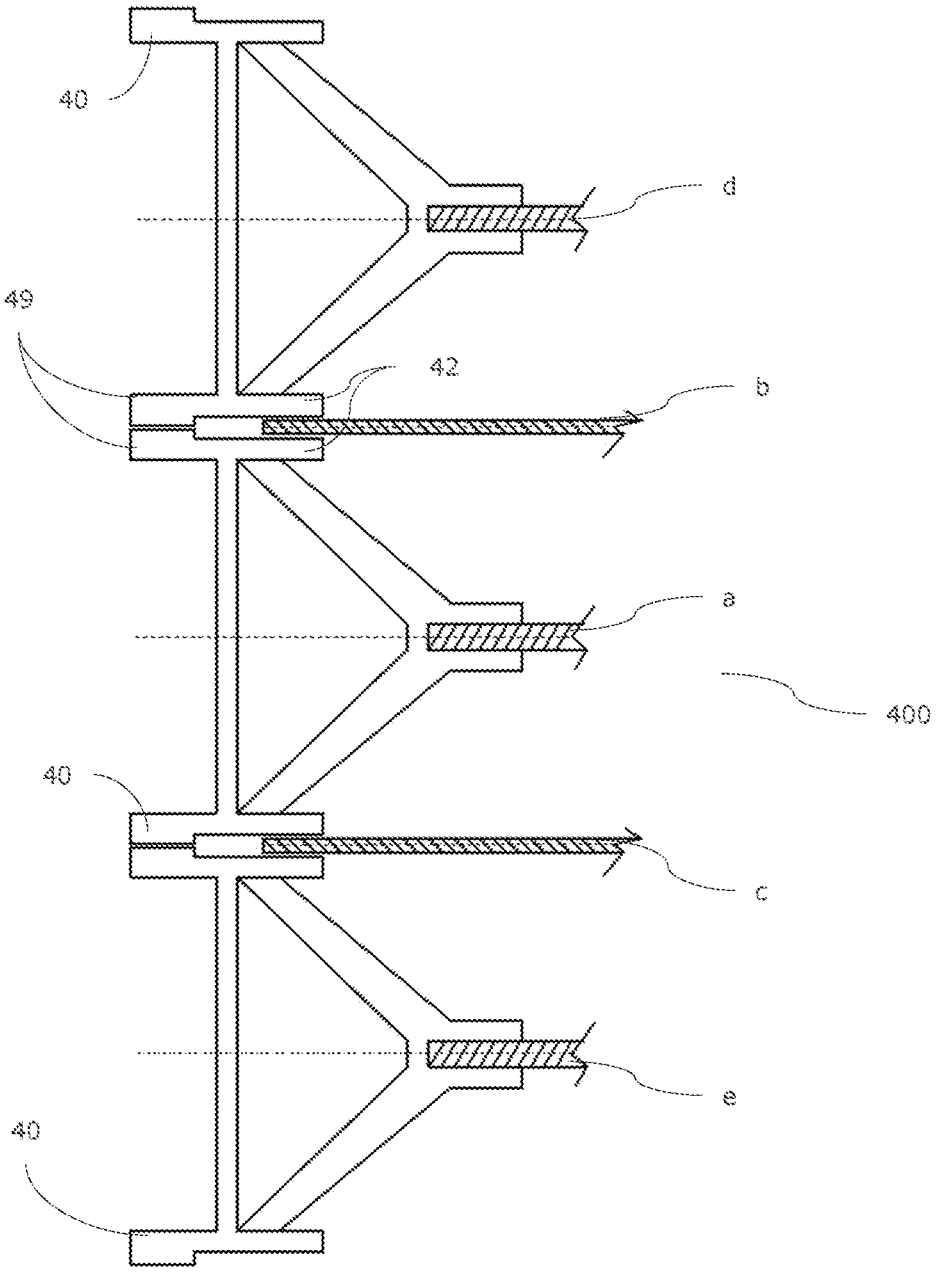
FIG. 4*g* shows the arrangement of the devices that are part of the system of the invention in relation to the adjacent electrodes, according to the embodiment of FIG. 4.

FIG. 4*f* shows a scheme of the electrolyte flow regulator device (40) assembled on both side edges of a number of electrodes (a), preferably anodes, forming an electrolyte flow regulator system (400).

Additionally, FIG. 4*g* shows the arrangement of the devices (40) that are part of the system (400) of the invention in relation to the adjacent electrodes and allowing to identifying the operation of the system. In fact, if we consider the central electrode (a) of FIG. 4*g* that comprises the device (40) of the invention, two adjacent electrodes, one on each side, shown as free plates (b, c) without any element on the edge (without edge strips) and the adjacent electrodes (d, e) towards said free plates to the ends of FIG. 4*g*, each one of them comprising the device (40) of the invention, it is possible to note that the arrangement of the system (400) of devices of the invention allows preventing the formation of deposit over the edges of the free plates (b, c) thus preventing the jacketing of the free plates (b, c) without the need of having edge strips. In particular, the configuration of the device (40) of the invention, one on each side of a free plate (b, c), presenting parallel lateral walls (42) and the stepped recess (49), allows throttling the flow of the electrolyte towards the edges of the free plate (b, c), thus preventing the electrodeposition over the edges of said free plate (b, c).

As an example, the central electrode (a) in FIG. 4*g* is an anode with the device (40) of the invention and, therefore, the two electrodes (b, c) adjacent to said central anode represent cathodes without edge strips, while the electrodes (d, e) to the ends of the figure are also anodes with the device (40) of the invention.

Additionally, embodiments of the device of the invention comprise a hollow structure with a number of through openings along its extension (28, 38, 48), preferably arranged perpendicular to the longitudinal plane, which can be seen on the embodiments of FIGS. 2, 3 and 4. Said through openings allow the free pass of the metal-rich electrolyte to be deposited in the deposition area. Through these through openings, the uniform deposition of metal in the cathode is achieved, thus allowing the renewal of the electrolyte by facilitating its free circulation through said through openings.

Finally, it should be noted that the configuration of the different electrolyte flow regulator devices of the invention not only allows preventing the use of edge strips by avoiding electrodeposition over the edge of the cathode, but it also allows a uniform and regular electrodeposition towards the edge, throttling the flow of electrolyte uniformly and, therefore, the flow of current generating the metal deposition toward the edges of each cathodic plate, generating an area of uniform deposition that meets the high standards of the industry, which is comparable with the current use of edge strips in terms of quality of the deposition and, at the same time, avoiding the high costs and delays involved by the use of edge strips.

The invention claimed is:

1. An electrolyte flow regulator device, to eliminate electrode edge strips, wherein the regulator device is formed by a stiff monolithic body comprising:

symmetrical side walls with respect to a longitudinal plane, arranged towards the sides of the regulator device; and an electrode fitting area, arranged in the middle part of the regulator device;

wherein the side walls of the regulator device incorporate an electrolyte flow regulating element; and wherein the electrolytic flow regulating element is selected from the group consisting of:

slightly inclined side walls, which configure a U-shaped or V-shaped cross section, wider at a rear of the side walls;

side walls with a step-shaped recess, symmetrical with respect to the longitudinal plane; and a combination of any one of the above.

2. The regulator device according to claim 1, wherein the side walls, with a step-shaped recess, are parallel, and form a rectangular U-shaped cross section.

3. The regulator device according to claim 1, wherein the side walls, with a recess in the form of a step, are parallel, and form a rectangular H-shaped cross section.

4. The regulator device according to claim 1, wherein, when fixed on the edge of an anode, the step-shaped recess presents a first level to accommodate the cathode, and a second level to prevent the passage of electrolyte.

5. The regulator device according to claim 1, further comprising an upper fit, to accommodate an electrode holding bar.

6. The regulator device according to claim 1, wherein the external profile of the regulator device follows the internal profile at least on the lateral faces of the regulator device, presenting a front face, towards the electrode fitting area, which is sticking inwards, presenting a first inclination on each side that defines an edge outer side protruding from the frontal plane of the regulator device, on each side, wherein the fitting area is arranged towards the middle or central part of the regulator device, which is configured from a second inclination of the front face, which defines a central opening to house the electrode.

7. The regulator device according to claim 1, wherein the fitting area is presented in the entire front extension of the regulator device, as a single continuous fitting area that has fastening points in it.

8. The regulator device according to claim 1, wherein the fitting area is presented in parts of the front extension of the regulator device.

9. The regulator device according to claim 1, wherein the extension of the regulator device covers just the extension of an electrode, that is, from a holding bar to a lower edge of the electrode, or the regulator device extends beyond the extension of the electrode, at least by a lower part of the electrode.

10. The regulator device according to claim 1, further comprising a hollow structure with a series of through openings along the extension of the regulator device, wherein said through openings allow the electrolyte to pass freely.

11. An electrolyte flow regulator system, to eliminate electrode edge strips, comprising at least four electrolyte flow regulator devices according to claim 1, wherein said regulator devices are arranged on each side edge of two adjacent anodic plates.

12. The regulator device according to claim 8, wherein the fitting area is in the form of three discrete fitting areas that have fastening points in them.

* * * * *